United States Patent [19]

Sorenson

[11] Patent Number: 4,742,187

[45] Date of Patent: May 3, 1988

[54] ROTARY SWITCH WITH COMMON CONTACT

[75] Inventor: Richard W. Sorenson, Avon, Conn.

[73] Assignee: Carlingswitch, Inc., West Hartford, Conn.

[21] Appl. No.: 43,690

[22] Filed: Apr. 29, 1987

[51] Int. Cl.[4] ..... H01H 1/16; H01H 19/54; H01H 21/76

[52] U.S. Cl. ..... 200/11J; 200/11 K; 200/277

[58] Field of Search ..... 200/8 R, 8 A, 11 R, 200/11 C, 11 E, 11 EA, 11 G, 11 J, 11 K, 277, 291

[56] References Cited

U.S. PATENT DOCUMENTS

| | | | |
|---|---|---|---|
| 2,980,770 | 4/1961 | Nabstedt | 200/291 X |
| 3,226,496 | 12/1965 | Seabury, Jr. | 200/8 R X |
| 3,255,319 | 6/1966 | Paine | 200/291 X |
| 3,263,033 | 7/1966 | Metzger | 200/8 A |
| 3,311,717 | 3/1967 | Lace | 200/8 R |
| 3,383,478 | 5/1968 | Mandel | 200/8 R |
| 3,596,013 | 7/1971 | Pihl | 200/291 X |
| 3,974,348 | 8/1976 | Lipschutz | 200/11 C X |
| 4,623,763 | 11/1986 | Krause | 200/11 K |

*Primary Examiner*—J. R. Scott

*Attorney, Agent, or Firm*—McCormick, Paulding & Huber

[57] ABSTRACT

The housing has a cylindrical cavity and central bore in the bottom wall for rotatably receiving a post on the cylindrical control member and the terminals have upper ends defining circumaxially spaced fixed contacts. A tubular conductor surrounds the post and is connected to one such fixed contact to provide a common contact adjacent all of the other fixed terminals. A ball is biased downwardly into contact with the common contact and selectively with the fixed contacts. The ball is provided in a recess of the rotary control member and moves over protuberances in the bottom wall of the housing to selectively connect the common contact with the individual fixed contacts.

10 Claims, 4 Drawing Sheets

ROTARY SWITCH WITH COMMON CONTACT

CROSS REFERENCE TO RELATED APPLICATION

This application is an improvement over that disclosed in a copending application entitled "ROTARY SWITCH" filed by the same inventor and assigned to the assignee herein, being identified by Ser. No. 945,880, filed Dec. 22, 1986, said copending application being a continuation-in-part of Ser. No. 884,545, filed July 11, 1986 and now abandoned. The disclosure in said copending application Ser. No. 945,880 is incorporated by reference herein.

SUMMARY OF INVENTION

This invention relates generally to rotary switches, and deals more particularly with a rotary switch having the same general size, and operating member configurations as those described in the above-identified copending application, but also having one of the fixed terminals electrically connected to a common contact so that rotation of the actuator knob or key serves to selectively connect any one of a plurality of the fixed contact terminals to a common terminal.

In a preferred form of the invention the switch housing comprises a generally cylindrical dielectric plastic body portion defining an upwardly open cylindrical cavity with a bottom wall in which a plurality of openings are provided for the fixed contacts or terminals. A control member or actuator has at least one downwardly open generally rectangularly shaped retainer recess that is spaced radially from the axis of rotation of the control member a distance corresponding to the radial spacing of these fixed contacts from said axis. Means is provided for restraining the control member from movement axially relative to the body portion and the movable contact element comprises a ball provided below a retainer that is biased downwardly by a force that is radially spaced to the geometric center of the ball so that the ball is urged not only downwardly but also in a radial direction by this biasing force. The common contact includes not only one of the fixed contact terminals, but also includes a tubular wall portion defining a plurality of radially open recesses for receiving a spherical segment of the spherically shaped ball element. These recesses are provided in angularly spaced positions such that the ball is positioned on each of the fixed contacts upper ends to be electrically connected selectively to this common contact. These radially open recesses are preferably elongated in a vertical direction such that the ball contacts both sides of the opening as well as the upper end of the fixed contact to be held positively in this position for each of the several stable switch positions. The bottom wall of the upwardly open cavity defines raised land portions that serve to move the ball upwardly as the control member is rotated and the ball moves off one fixed contact toward an adjacent fixed contact. These raised lands define depressions therebetween, each depression being associated with one of the fixed contact upper ends.

The improved rotary switch with common contact described herein can be provided with a two-piece housing rather than the one-piece housing disclosed herein, which two-piece housing version may be equipped with a key operated actuator all as described in my above mentioned copending patent application.

DETAILED DESCRIPTION

Figure 1:
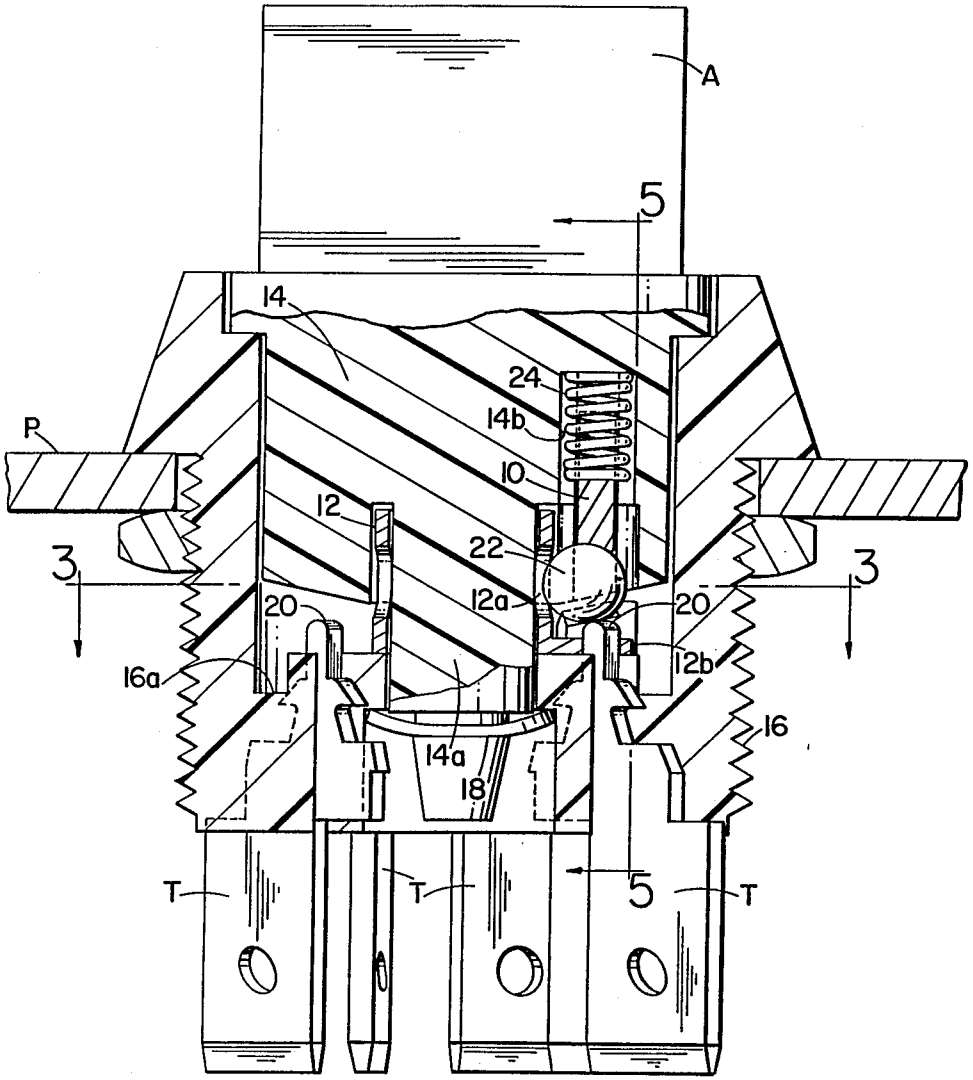
FIG. 1 is a vertical section through a rotary switch equipped with a common contact in accordance with the present invention, the movable contact ball being illustrated in switch OFF condition.
Figure 4:
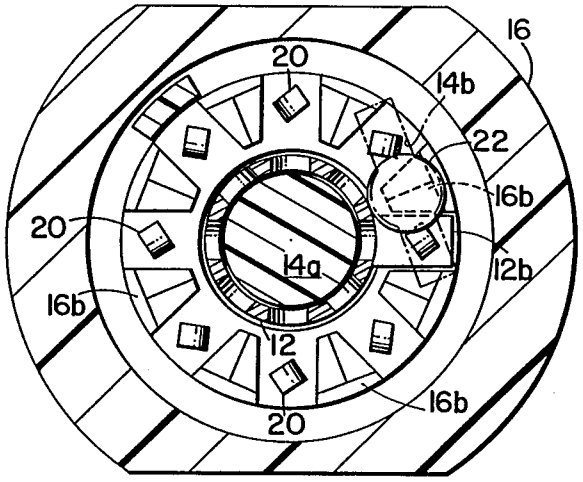
FIG. 4 is a view similar to FIG. 3 but taken on the line 4—4 of FIG. 2.

The rotary switch of the present invention has many of the same features and advantages afforded by the rotary switch of my above-identified copending patent application. More particularly, eight uniquely configured fixed terminals are provided in a circumaxially spaced array such that each terminal is inclined at approximately 45 degrees to a radial line constructed from the longitudial central axis of the generally cylindrical switch housing. The housing itself is of the same general dimensions and defines an upwardly open cavity having a bottom wall **16*a* that includes an arcuate groove defining stop surfaces for a depending leg provided on the generally cylindrical control member or actuator. The external surface of the body portion may be threaded to receive a nut, and may include a downwardly facing flange adjacent its upper end so that the rotary switch can be mounted in the panel P as illustrated in FIG. 1. The control member or actuator defines a diametrically extending actuator portion A or some other configuration may be provided in the form of knob. The housing portion or body 16 may instead be defined in two parts all as described in greater detail in the above-identified patent application. Each of the fixed contact terminals T is preferably formed as a flat metal component having a lower portion protruding below the bottom wall of the housing 16 and defining the terminal end, and having an upper portion offset radially inwardly from this lower portion to define the fixed contact upper end 20. The upper ends 20, 20 of these fixed contacts are spaced radially at least approximately one-half the radius of the body portion 16**.

The control member or actuator 14 includes at least one downwardly open retainer recess **14*b* which recess includes a generally cylindrical central bore for receiving the coiled compression spring 24 that acts on the retainer 10 to urge the retainer downwardly in the recess 14*b* in a manner generally similar to that described in the aforementioned copending patent application. Recess 14*b* like that of my copending disclosure includes a generally rectangularly shaped cross sectional portion on a common axis with the bore for slidably receiving the retainer 10 and restricting the retainer 10 to motion vertically relative to the rotary actuator 14**.

The rotary actuator 14 also includes a downwardly projecting post 14*a* that is received in a central bore or opening provided for it in the body portion 16. The rotary actuator 14 is retained in the body portion 16 and is restricted from axial movement relative thereto by a retainer 18 in a manner similar to that described in the above-identified copending application. Other configurations for retaining the control member in the body portion can be provided all as suggested in my above identified copending application.

Figure 2:
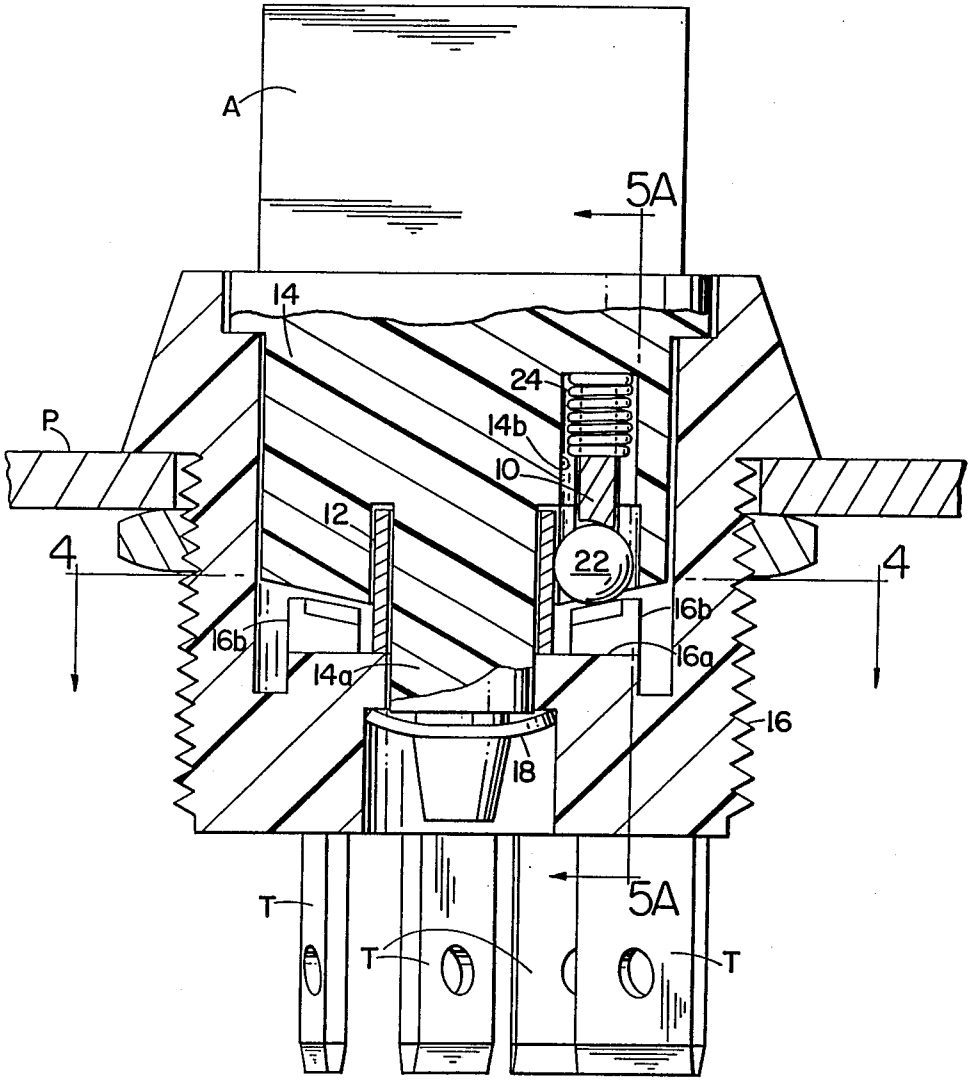
FIG. 2 is a view similar to FIG. 1, but shows the ball contact in a transient position between ON and OFF.
Figure 6:
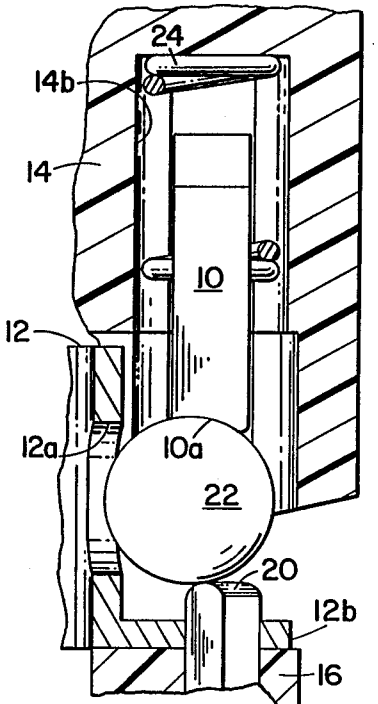
FIG. 6 is an expanded view of the contact area depicted in FIG. 1.
Figure 5:
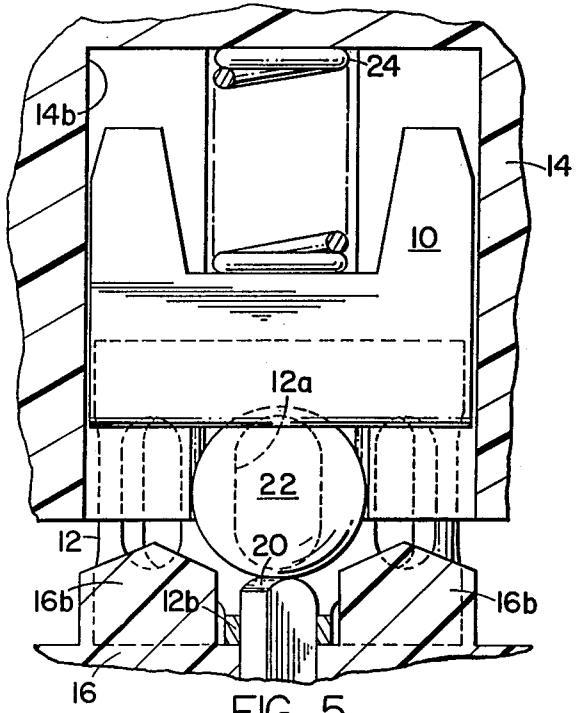
FIG. 5 is a vertical sectional view taken generally on the line 5—5 of FIG. 1, and illustrates the spherical ball contact in engagement with a fixed contact upper end.
Figure 7:
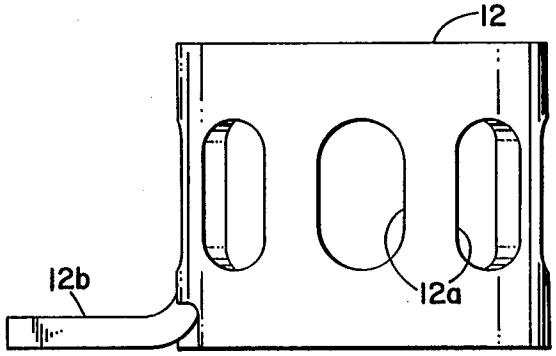
FIG. 7 is an elevational view of the common contact element illustrated sectionally in FIGS. 1–6A.

In accordance with the improvement presented for the first time in the subject application a fixed common contact 12, best shown in FIG. 7 is provided radially inwardly of the fixed contact upper ends 20 to be selectively connected thereto by the spherically shaped ball element 22. The ball element 22 is shown in an OFF position in FIG. 1, the ball element being seated or held in an elongated oval shaped opening 12*a* provided in the side wall portion of common contact 12. FIG. 2 shows the ball in a transient position between the OFF position of FIG. 1 and an ON position (not shown) but similar to that of FIG. 1. FIGS. 5 and 6 illustrate the ball 22 held in a stable condition such that it contacts the upper end of fixed contact 20 and also has a spherical segment or portion seated in the generally oval shaped opening 12*a* of the common contact 12. The lower end 10*a* of retainer 10 acts on the ball 22 on a line L that is spaced radially outwardly of the center of the ball 22 for urging the ball into the position illustrated for it in FIGS. 5 and 6.

Figure 6A:
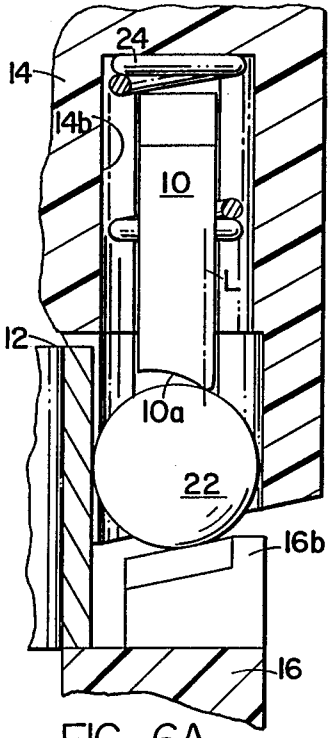
FIG. 6A is a view similar to FIG. 6 but showing the contact area as depicted in FIG. 2.
Figure 5A:
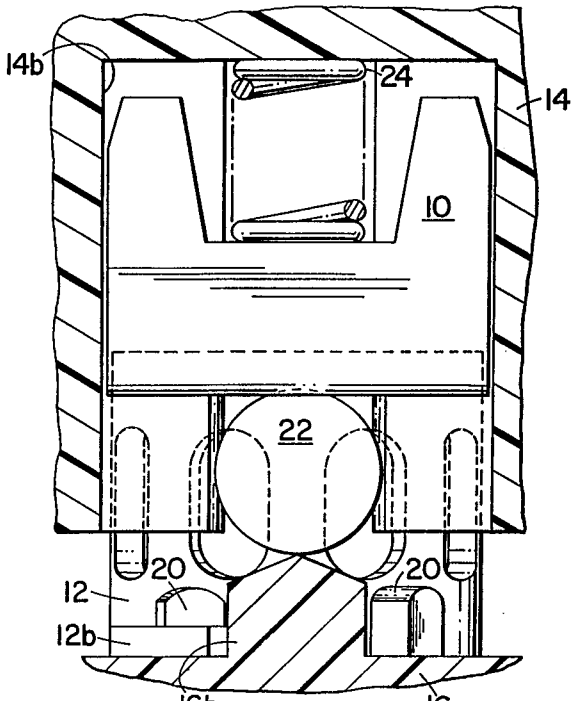
FIG. 5A is a view similar to FIG. 5, but taken on the line 5A—5A of FIG. 2.

Rotating the actuator 14 from the above described FIG. 1 position will cause the ball 22 to move out of the opening 12*a* provided for it in the common contact 12 and to assume a position such as illustrated generally in FIGS. 2 and 6A. As the ball is rotated in this manner it rolls upwardly over a raised land such as that illustrated at 16*b*, such vertical motion of the ball being accommodated by the resilient spring 24 acting against retainer 10 to support the ball 22 as shown in FIGS. 5A and 6A. Even as the ball is moved out of an opening 12*a*, as shown in FIG. 5A, it will be apparent that the retainer 10 acts on the ball radially outwardly of its center so as to achieve the requisite degree of control over ball movement during rotation for the actuator. The lower end 10*a* of retainer 10 has a canted ball engaging shape so that the line of action L in FIG. 6A is actually shifted radially outwardly as shown.

Figure 3:
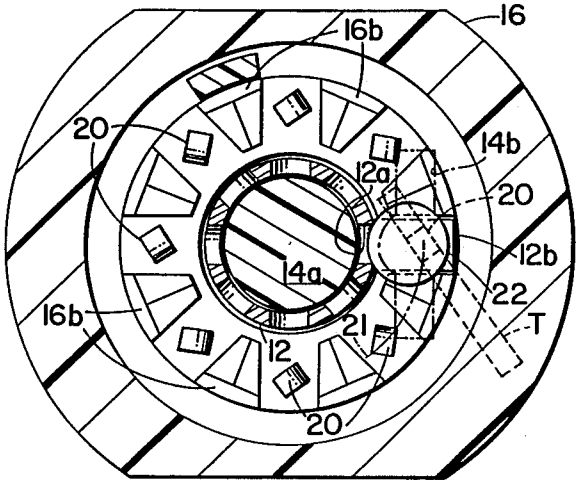
FIG. 3 is a horizontal sectional view taken generally on the line 3—3 of FIG. 1, and illustrates the spherically shaped movable contact element in positions corresponding to those illustrated in FIG. 1.

As best shown in FIGS. 2 and 3 the bottom wall 16*a* of upwardly open cavity in the housing 16 has a plurality of raised lands 16*b*, 16*b* defined integrally therein, the number of such lands being equal in number to the number of openings provided to receive the fixed contacts 20, 20.

With particular reference to FIG. 3 the common contact 12 can be seen from this view to have a generally tubular configuration with a plurality of circumaxially spaced openings 12*a* provided in positions corresponding radially to the circumaxial positions for the fixed contact upper ends 20. One such fixed contact 20 is electrically connected or coupled to the common contact by means of a radially extending lower leg 12*b* that is preferably integrally formed in the common contact 12 and includes a slot for receiving one fixed contact upper end 20 as best shown in FIGS. 3 and 5. As suggested by the arcuate line 21 in FIG. 3 the common contact ball travels in a generally circular path around the common contact 12 but will seat itself within each of the openings 12*a*, 12*a* as it comes into contact with each of the upper ends 20 of the fixed contacts. Only one of these fixed contacts is associated and directly connected to the common contact 12 as suggested at the three o'clock position in FIG. 3 for example. Each of the openings 12*a* in the tubular common contact wall portion has a generally elongated oval shape being elongated vertically to provide two point contact for the ball 22. Thus, the spherical ball 22 will actually contact the common contact 12 at horizontally spaced points to provide such two point contact. The upper end 20 of the fixed contact also acts on the ball providing a stable three point contact for the ball. This geometry provides a stable position for the ball 22 in each of its eight positions. Seven ON positions are provided for, the three o'clock position for the ball being a neutral or OFF position since the common contact 12 is electrically connected to said one fixed contact 20 at this location. This configuration serves two purposes, one to electrically connect the common contact 12 to a desired potential or voltage, and to provide an OFF position for the rotary switch.

I claim:

1. A rotary switch comprising a generally cylindrical dielectric body portion defining an upwardly open cavity of generally cylindrical shape, said cavity having a longitudinal axis, said body portion having a bottom wall defining a plurality of circumaxially spaced openings, fixed contacts provided in at least some of said openings such that upper ends of said fixed contacts are spaced radially between said cavity axis and the cylindrical cavity wall, a generally cylindrical dielectric control member rotatably received in said cavity, means for restraining said control member from movement axially in said cavity, said control member having at least one downwardly open retainer recess, said recess spaced radially from said axis a distance corresponding to the radial spacing of said fixed contact upper ends, a spherically shaped movable contact element loosely received in said retainer recess, a common contact connected to one of said fixed contacts and having an upwardly projecting wall portion spaced radially from said fixed contact upper ends, said common contact wall portion being of arcuate contour and in continuous contact with said spherically shaped contact element, said common contact wall portion having radially open recesses for receiving segments of said spherically shaped element such that angularly spaced positions are provided for said spherically shaped element wherein said spherically shaped element also contacts one of said fixed contact upper ends and, means biasing said spherically shaped element radially into one of said radially open recesses to provide a positive detent for supporting said spherically shaped element on said one fixed contact.

2. The rotary switch of claim 1 further characterized by said means biasing said spherically shaped contact element radially toward said common contact wall portion also biasing said spherically shaped contact element downwardly.

3. The rotary switch of claim 2 wherein said control member has a depending central post received in a central bore defined by said body portion bottom wall, and said means restraining said control member comprising retaining means securing said post against axial upward movement relative said bore.

4. The rotary switch of claim 1 wherein said fixed contacts upper end are provided in depressions defined between raised lands of said bottom wall, said segment of said spherically shaped movable contact element being so received in one of said radial recesses of said common contact only when said element is provided in said depression.

5. The rotary switch of claim 4 further characterized by said means biasing said spherically shaped contact element radially toward said common contact wall portion also biasing said spherically shaped contact element downwardly.

6. The rotary switch of claim 5 wherein said control member has a depending central post received in a central bore defined by said body portion bottom walls, and said means restraining said control member comprising retaining means securing said post against axial upward movement relative said bore.

7. The rotary switch of claim 5 wherein said means biasing said spherically shaped contact element comprises a retainer slidably received in said retainer recess for movement parallel said axis, said retainer having a concave lower surface engaging another segment of said spherically shaped element located diametrically opposite said segment so received in said radial recess of said common contact wall portion, and a compression spring also provided in said retainer recess and acting on said retainer to urge said retainer downwardly and said spherically shaped element with a biasing force that includes a radial component.

8. The rotary switch of claim 7 wherein said common contact wall portion has a tubular configuration and wherein said common contact also includes a radially extending lower leg that has a slot for receiving said one fixed contact upper end, and said radial recesses provided in circumaxially spaced relationship in radial alignment with said fixed contact upper ends.

9. The rotary switch of claim 8 wherein said radial recesses in said common contact wall portion comprise slightly elongated through holes having a slightly longer vertical opening size than horizontal opening size.

10. The rotary switch of claim 9 wherein said tubular wall portion of said common contact is provided radially inwardly of said circumaxially spaced fixed contact upper ends, and wherein said baising force from said spring and retainer has a radially inwardly directed component.

* * * * *